US007497727B2

(12) United States Patent
Ting

(10) Patent No.: US 7,497,727 B2
(45) Date of Patent: Mar. 3, 2009

(54) CARD CONNECTOR

(75) Inventor: Chien-Jen Ting, Tu-cheng (TW)

(73) Assignee: Hon Hai Precision Ind. Co., Ltd., Taipei Hsien (JP)

( * ) Notice: Subject to any disclaimer, the term of this patent is extended or adjusted under 35 U.S.C. 154(b) by 0 days.

(21) Appl. No.: 12/148,044

(22) Filed: Apr. 16, 2008

(65) Prior Publication Data

US 2008/0254659 A1 Oct. 16, 2008

(30) Foreign Application Priority Data

Apr. 16, 2007 (TW) ..... 96206065 U

(51) Int. Cl.
*H01R 13/60* (2006.01)

(52) U.S. Cl. ..... 439/541.5; 439/607; 439/159

(58) Field of Classification Search ..... 439/541.5, 439/607, 79, 159
See application file for complete search history.

(56) References Cited

U.S. PATENT DOCUMENTS 7,014,506 B2 * 3/2006 Ho et al. ..... 439/607
7,018,234 B2 * 3/2006 Tanigawa et al. ..... 439/541.5
7,063,539 B2 6/2006 Ho
7,086,906 B1 8/2006 Ting
7,108,545 B2 * 9/2006 Ting ..... 439/541.5
2005/0118863 A1 * 6/2005 Tanigawa et al. ..... 439/541.5

* cited by examiner

*Primary Examiner*—Hien Vu
(74) *Attorney, Agent, or Firm*—Wei Te Chung

(57) ABSTRACT

A card connector (100) includes a connector housing (90, 90') having a card receiving room (9, 9') for receiving a card and defining a card inserting/ejecting direction, a shell (4), a terminal module (70) assembled with shell and receiving a plurality of terminals (32) retained in the housing and protruding into the card receiving room to electrically connect with a card, and an insulating body (5) covered by the shell to define the card receiving room and having a main body (50) comprising a pressing piece (502) protruding into the receiving room along the card insertion direction, one end of the pressing piece in a relax and free state therein and the other end connecting with the insulating body. Wherein the pressing piece is opposite to the terminal module for pressing on a inserting card.

8 Claims, 4 Drawing Sheets

CARD CONNECTOR

BACKGROUND OF THE INVENTION

1. Field of the Invention

The present invention relates to a structure of a card connector used for memory cards for using in various portable information equipments, such as a portable telephone or a NoteBook, or memory support equipments such as a digital camera or a digital AV equipment.

2. Description of Prior Arts

A card connector is generally used as an expanded recording apparatus of an electronic equipment such as a personal computer or a digital camera. As a storage medium of the card connector, a PC card or a memory card has come into wide use.

However the personal computer or the digital camera are always shaken or rocked. In such case, the card will get away from an original position, and a desirable connection between the card and the connector is damaged.

Therefore, it is desirable to provide a card connector that eliminates the aforesaid problems.

SUMMARY OF THE INVENTION

An object, therefore, of the invention is to provide a card connector receiving terminals capable of preventing the terminals from being damaged by an insertion card.

In the exemplary embodiment of the invention, a card connector includes a connector housing having a card receiving room for receiving a card and defining a card inserting/ejecting direction, a shell, a terminal module assembled with shell and receiving a plurality of terminals retained in the housing and protruding into the card receiving room to electrically connect with a card, and an insulating body covered by the shell to define the card receiving room and having a main body comprising a pressing piece protruding into the receiving room along the card insertion direction, one end of the pressing piece in a relax and free state therein and the other end connecting with the insulating body. Wherein the pressing piece is opposite to the terminal module for pressing on a inserting card.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
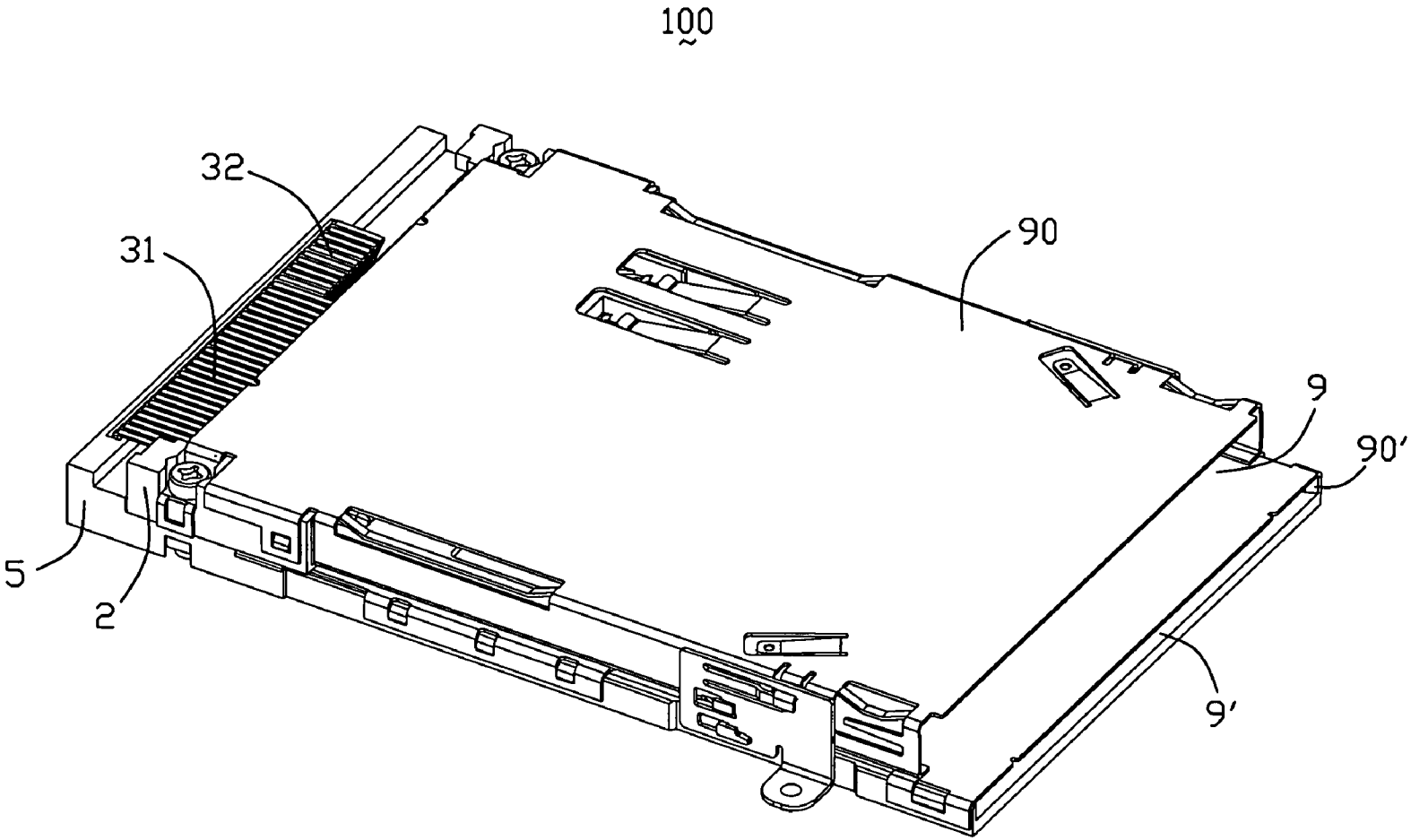
FIG. 1 is a perspective view of a card connector in accordance with present invention.
Figure 2:
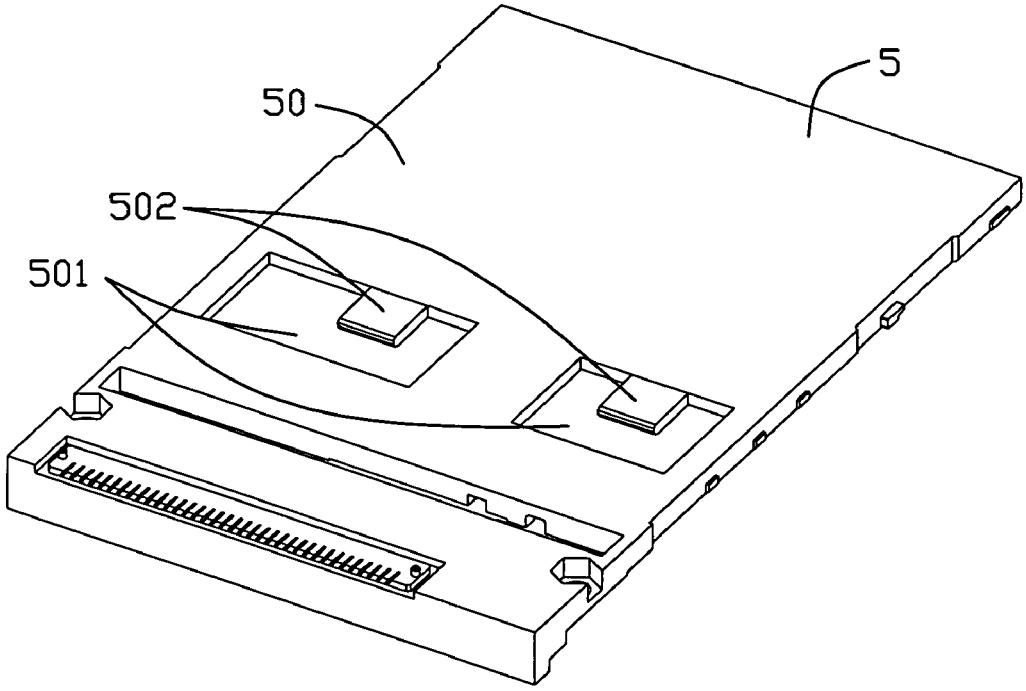
FIG. 2 is a perspective of a insulating body of the card connector is replaced from the card connector.
Figure 2:
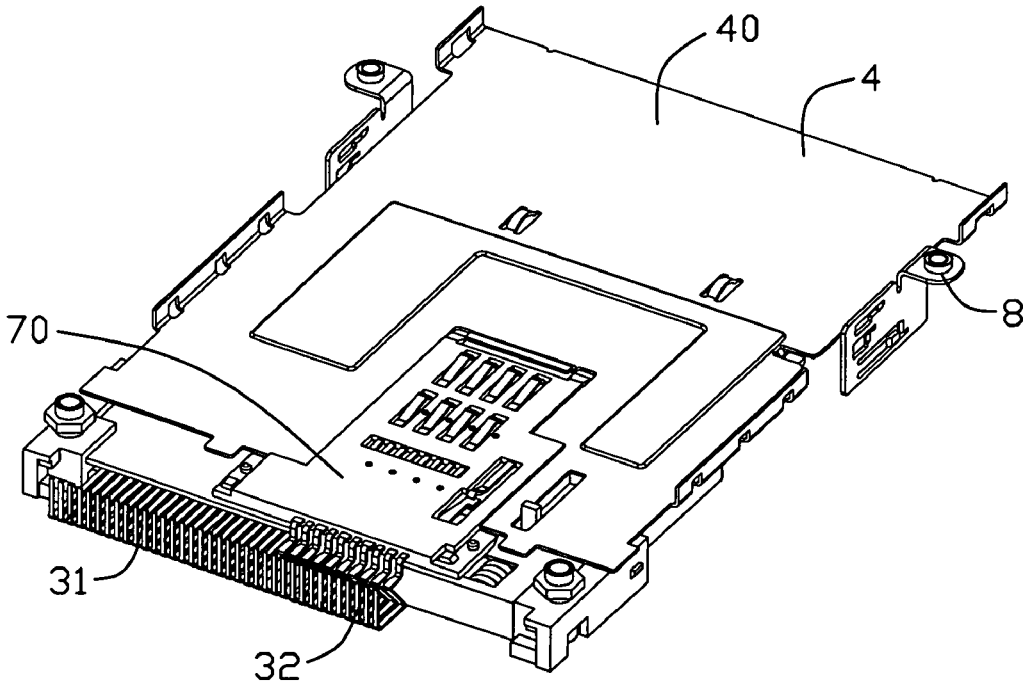
Figure 3:
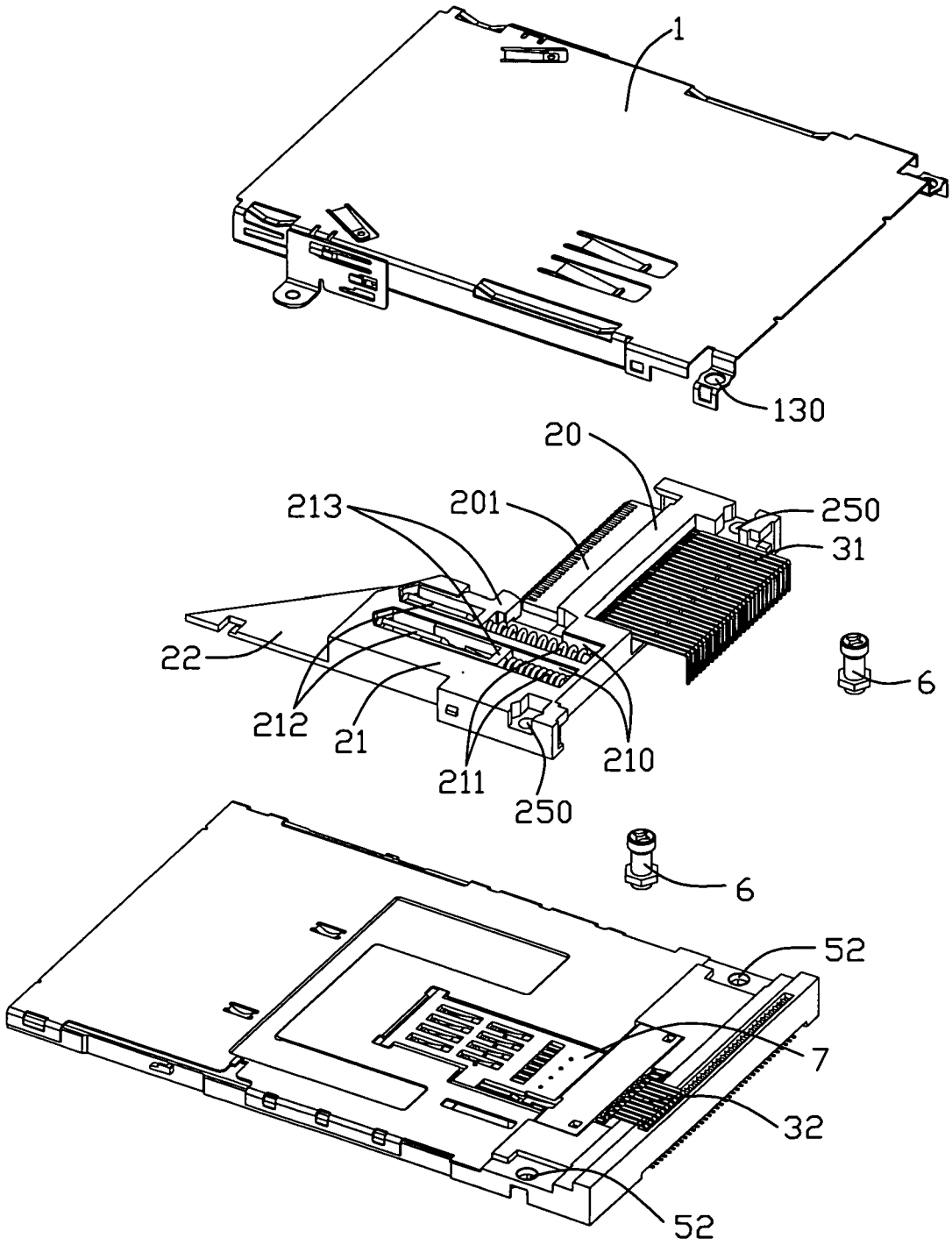
FIG. 3 is a exploded view of the card connector as show in FIG. 1.
Figure 4:
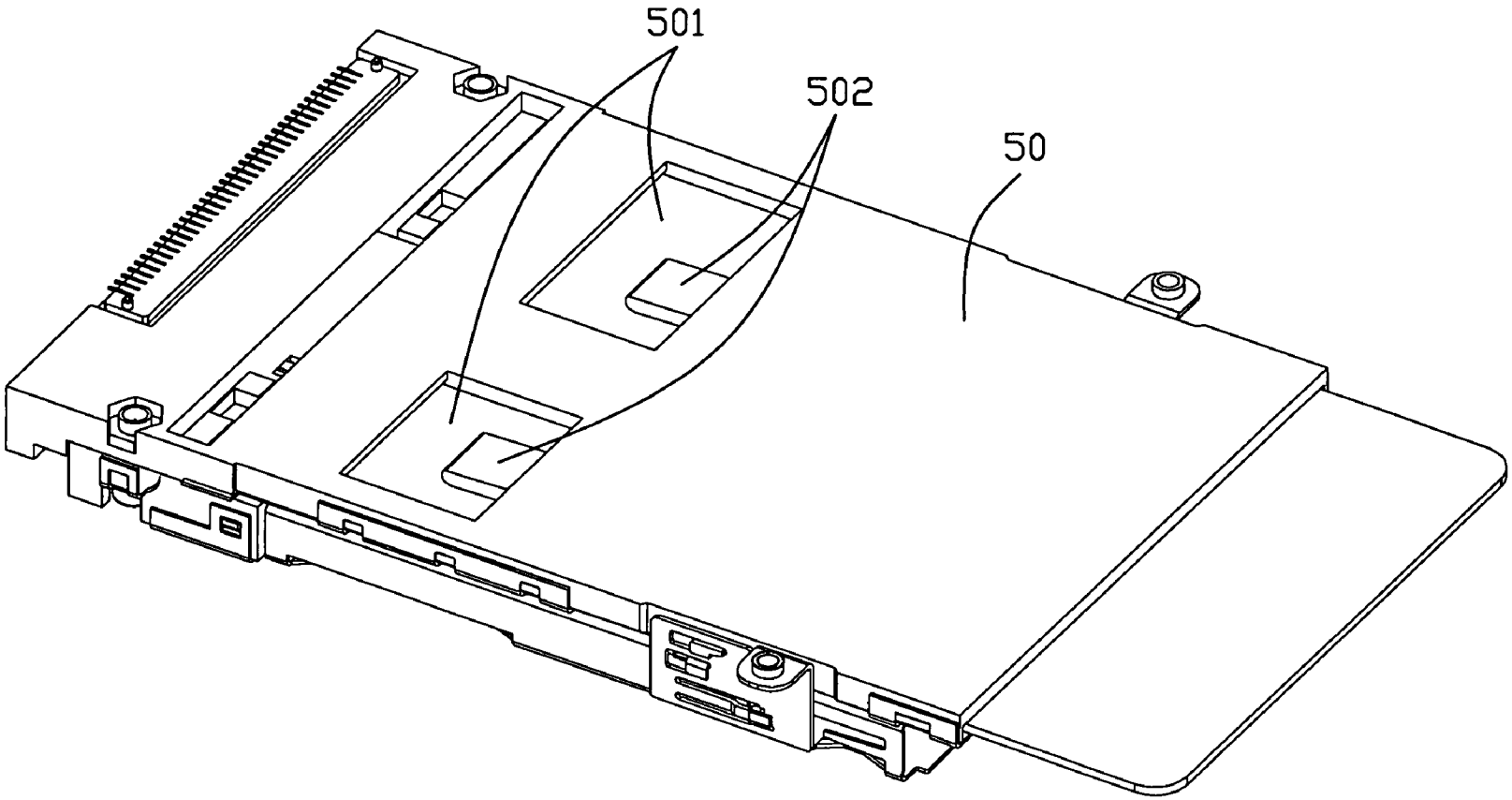
FIG. 4 is a perspective view of the card connector in another aspect as shown in FIG. 1 when a card is inserted.

Referring to FIG. 1 to FIG. 4, a card connector 100 for receiving a first card, such as a Smart Card, and a second card, such as an Express Card, in accordance with present invention comprises a first housing 90' and a second housing 90 mounted on the first housing 90' relative to a printed circuit board (not shown), and each housing is designed with a card opening (not labeled) for a card inserted or ejected.

The first housing 90' comprises a first shell 4, a terminal module 70 assembled with the first shell 4, and an insulating body 5 covered by the first shell 4 to define a first receiving room 9'. The terminal module 70 receives a plurality of first terminals 32 protruding into the first receiving room 9' for engaging with the first card. The insulating body 5 comprises a main plate 50 having a pair of holes 501 with generally a square shape. Each hole 501 forms a pressing piece 502 extending partially from one edge thereof along an insertion direction of a card and protruding into the first receiving room 9'. In this embodiment, the pressing pieces 502 are placed right above the terminal module 70 on the first shell 4. When a card inserted, the pressing pieces 502 press on the card to achieve a desirable connection between the card and the first terminals 202, regardless a shake or rock of the card connector.

The second housing 90 comprises an insulating housing 2, a plurality of second terminals 31 retained in the insulating housing 2 and a second shell 1 mounted on the insulating housing 2. The second terminals 31 are arranged in a transverse direction perpendicular to a insertion direction of the card. The insulating housing 2 comprises a base section 20, a fixing portion 21 integrally extending from one end of the base section 20 and a guiding portion 22 extending from the fixing portion 21 opposite to a card insertion direction. The base section 20 has a engaging plate 201 protruding into the second receiving room 9, and the second terminals 31 protrude out of the engaging plate 201 to engage with the second card. On the fixing portion 21, a pair of groove 210 are placed in the same direction of the second terminals 31 arranged to receive two ejecting mechanisms (not labeled). The ejecting mechanisms, respectively, comprises an ejecting device 213 protruding into the receiving space, a spring device 211 for moving the ejecting device 213 in the card ejecting direction, a latch device 212 capable of overcoming the spring device 211 and placing the ejecting device 213 in a desirable position. Each ejecting device 213 has a limiting groove (not shown) allowing one end of the latch device 212 to slide therein. The operating process of the ejecting mechanism is omitted in this specification because it is knew as a published skill.

The second shell 1, the insulating housing 20 and the insulating body 5 define a pair of screw holes 130, 250, 52 at the opposite ends thereof, respectively. When the first housing 90 and the second housing 90' are assembled, a pair of screws 6 passing through the holes in order to fasten the end portion of the card connector 100. Furthermore, a pair of standing members 8 are mounted on the lateral sides of the card connector 100 to fasten a front portion of the first housing 90 and the second housing 90' together and then printed on the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A card connector comprising:

a connector housing having:

a card receiving room for receiving a card and defining a card inserting/ejecting direction;

a conductive shell;

a terminal module assembled with the shell and receiving a plurality of terminals retained in the housing and protruding into the card receiving room to electrically connect with a card; and an insulating body covered by the shell to define the card receiving room and having a main body comprising pressing pieces protruding into the receiving room along the card insertion direction, one end of the pressing piece in a relax and free state therein and the other end connecting with the insulating body;

wherein the pressing pieces are formed on opposite sides of the terminal module for pressing on an inserting card;

wherein the card connector further comprising another housing hereafter named a second housing and defining another receiving room hereafter named a second receiving room, and said housing hereafter named a first housing with a first receiving room;

wherein each of the pressing pieces is surrounded by a hole, and the hole is bigger than the pressing piece;

wherein each of the pressing pieces is extending partially from one edge of the hole;

wherein the second housing comprises a second insulating housing having a fixing portion and a guiding portion, the fixing portion is placed at a lateral side of the narrower portion of the second receiving room, and the guiding portion integrally extending from the fixing portion;

wherein the fixing portion defines two grooves and two ejecting mechanism are mounted therein for ejecting cards in the first housing and the second housing, respectively.

2. The card connector as claimed in claim 1, wherein the first housing and the second housing are stacked.

3. The card connector as claimed in claim 1, wherein the pressing piece is placed right above the terminals to press the inserted card and achieve a stable connection between the card and the terminals.

4. The card connector as claimed in claim 1, wherein the hole is a square shape.

5. The electrical card connector as claimed in claim 1, wherein the pressing piece of the body plate is designed with two which are arranged above the terminal module.

6. The electrical card connector as claimed in claim 1, wherein the second receiving room defines a wider portion and a narrower portion along the card inserting direction.

7. The electrical card connector as claimed in claim 1, wherein the two grooves are placed along a transverse direction perpendicular to an inserting direction of a card.

8. The electrical card connector as claimed in claim 7, wherein each ejecting mechanism is urged by an inserted card.

* * * * *